US006032511A

United States Patent [19]

Tseng

[11] Patent Number: 6,032,511

[45] Date of Patent: Mar. 7, 2000

[54] THREE-DIMENSIONAL SIMPLE FLEXIBLE MOULD FOR BENDING PIPES

[76] Inventor: Shao-Chien Tseng, No. 130 Sec. 2 Yang-Shin Rd., Yang-Mei Taoyuan 326, Taiwan

[21] Appl. No.: 09/209,530

[22] Filed: Dec. 11, 1998

[51] Int. Cl.[7] ..... B21D 9/03

[52] U.S. Cl. ..... 72/466; 72/149; 72/398; 72/466.2

[58] Field of Search ..... 72/466.2, 466, 72/465.1, 466.8, 466.9, 398, 369, 150, 149, 154, 370.01; 425/392; 269/287; 267/167

[56] References Cited

U.S. PATENT DOCUMENTS

| | | | |
|---|---|---|---|
| 174,609 | 3/1876 | Wright | 72/466.2 |
| 279,573 | 6/1883 | Leaycraft | 72/466 |
| 2,963,068 | 12/1960 | Chiappe | 72/466 |
| 5,272,905 | 12/1993 | Parlow | 72/466 |

*Primary Examiner*—Daniel C. Crane
*Attorney, Agent, or Firm*—Pro-Techtor International Services

[57] ABSTRACT

A three-dimensional simple flexible mould for bending pipes comprised of a plurality of arciform or half-circled spring elements, pins and chucking rings for being a protecting mould in a three-dimensional pipe bending process. The two ends of every spring element have two lapping portions each with a hole for insertion of two common pins therethrough. One of the lapping portions on each of the spring elements is lapped over one of the lapping portions of the neighbored one of the spring elements at one side of the spring element and the other over another of the lapping portions of another neighbored one of the spring elements at the other side thereof. Such that said spring elements are strung to be in the form of a spiral spring typed flexible mould. The pins are provided on the two open ends thereof with annular grooves for engagement by the chucking rings to prevent the spring elements from dropping. Thereby, a straight pipe to be bent can be placed for being processed by a three-dimensional pipe bending process with a manual pipe bending machine or some other pipe bending equipment. This can increase the bending strength of the pipe under bending moment. The spring elements can scatter the stress in bending. The bending process is simple and can improve the technique of processing in making artificial pipes.

2 Claims, 5 Drawing Sheets

THREE-DIMENSIONAL SIMPLE FLEXIBLE MOULD FOR BENDING PIPES

BACKGROUND OF THE INVENTION

1. Field of the Invention

The present invention is related to a three-dimensional simple flexible mould for bending pipes. When a pipe-bending machine is used to execute a three-dimensional pipe-bending (or bending forming) process on a metallic pipe, the flexible mould suits those metallic pipes with smaller flexibility and stiffness as well as with smaller diameters and thin walls. The flexible mould can effectively scatter the stress on a pipe wall during bending process, and therefore loss of stiffness and deformation of the pipe wall due to stress concentration can be prevented.

2. Description of the Prior Art

In the known pipe-bending processing techniques, pipe-bending machines are used to directly bend and rectify steel alloy type straight pipes with larger stiffness. However, up to the present day, it is not that all metallic pipes are suitable for bending forming process. In fact, during bending forming, a pipe must have a certain thickness and stiffness in order to keep the capability of preventing from deformation.

The pipes are not suitable to be processed by bending forming directly with a pipe bending machine in the conventional techniques. This is because the material of which the metallic pipes are made has smaller stiffness than steel alloy. Therefore when in bending forming, the pipe wall is subjected to overly large concentration of stress, and the pipe wall is subjected to collapse.

And more, it is not that all steel alloy pipes are suitable for bending forming processes. In fact, a metallic pipe, no matter what material it is made of, will be more difficult to deal with in a bending forming process when its diameter is very small and its pipe wall is thinner. This is a technical impediment making difficulty of the bending forming process.

Based on the above stated reasons, mass production of three-dimensional metallic pipes in the industry has been being hard to put to practice by a simple way.

SUMMARY OF THE INVENTION

The present invention provides a three-dimensional simple flexible mould for bending pipes, the flexible mould has flexibility as of a spiral spring and provides convenience in assembling and detaching itself, thereby it can be slipped over a metallic straight pipe to be bending formed. When in bending forming the pipe, it can effectively scatter the bending moment in the pipe wall, this can avoid overly concentration of stress which can damage the pipe wall by deformation and collapsing. By this means, simplicity as well as convenience in the three-dimensional bending operation on the pipe can be increased.

The present invention is especially related to making the spiral spring typed flexible mould easier to be assembled and detached. So that when the metallic straight pipe is bending formed into a three-dimensional bended article, the flexible mould on the shaped bended pipe can still be detached in a simple way. Therefore, the flexible mould is recoverable.

In order to get the above object, the present invention is adapted to take a three-dimensional bending forming process with a pipe-bending machine available in the markets or with a multiple-axial oil pressure bending forming equipment with numerical control of a micro-computer. However, the main object is to complete a design for a practical and convenient flexible mould rather than to select a bending forming equipment.

The present invention will be apparent by the detailed description of the present invention in reference to the accompanying drawings.

DETAILED DESCRIPTION OF THE PREFERRED EMBODIMENT

Figure 1:
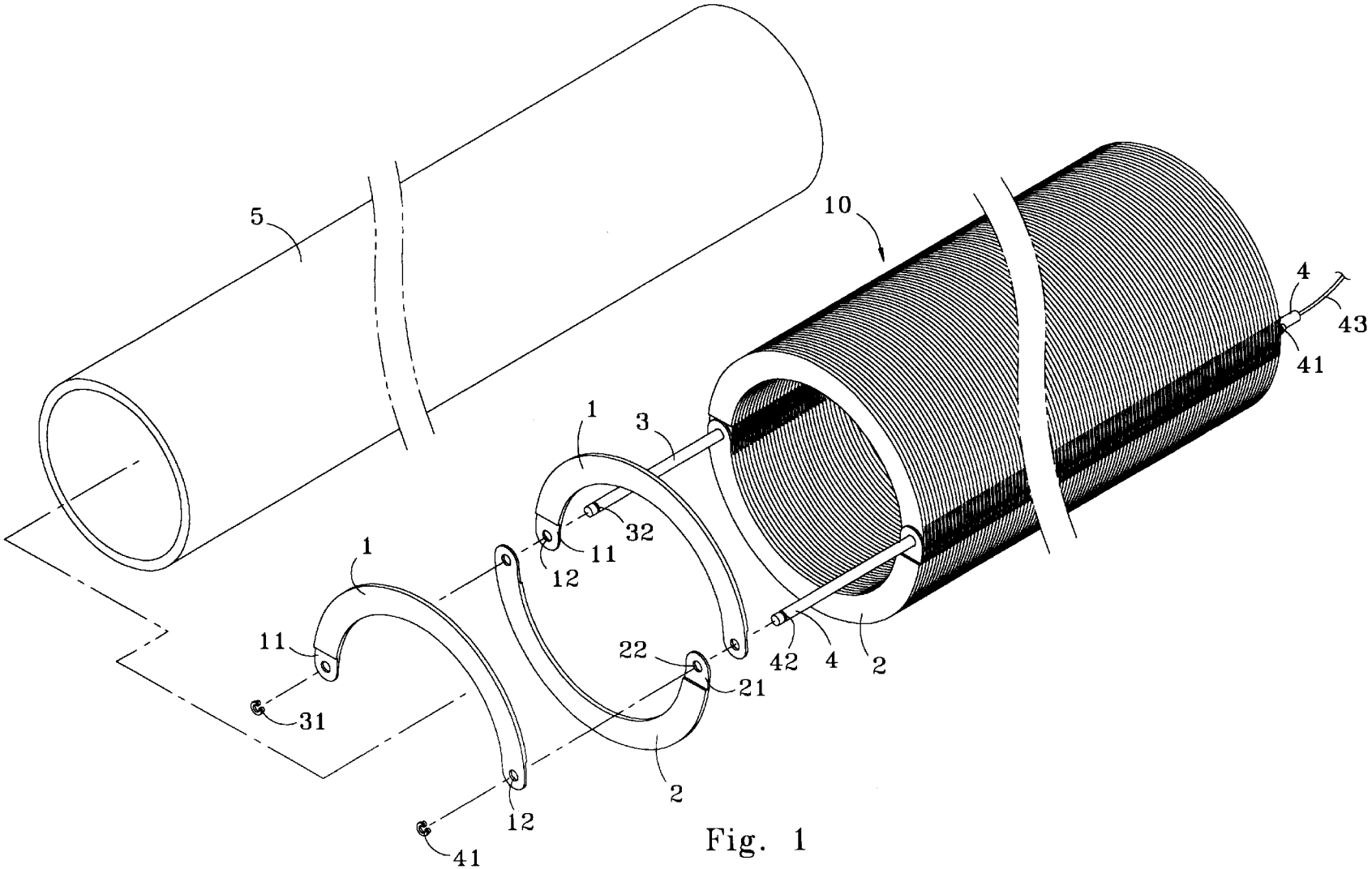
FIG. 1 is an analytic perspective view of the present invention.

Referring firstly to FIG. 1, the three-dimensional simple flexible mould 10 for bending pipes of the present invention is comprised of the simple elements of a plurality of arciform or half-circled spring elements 1 and 2, more than one pins 3 and 4 as well as chucking rings 31, 41. Among the pins 3 and 4, at least a pin 4 is provided on the tailing end thereof with a spring steel wire 43.

Figure 2:
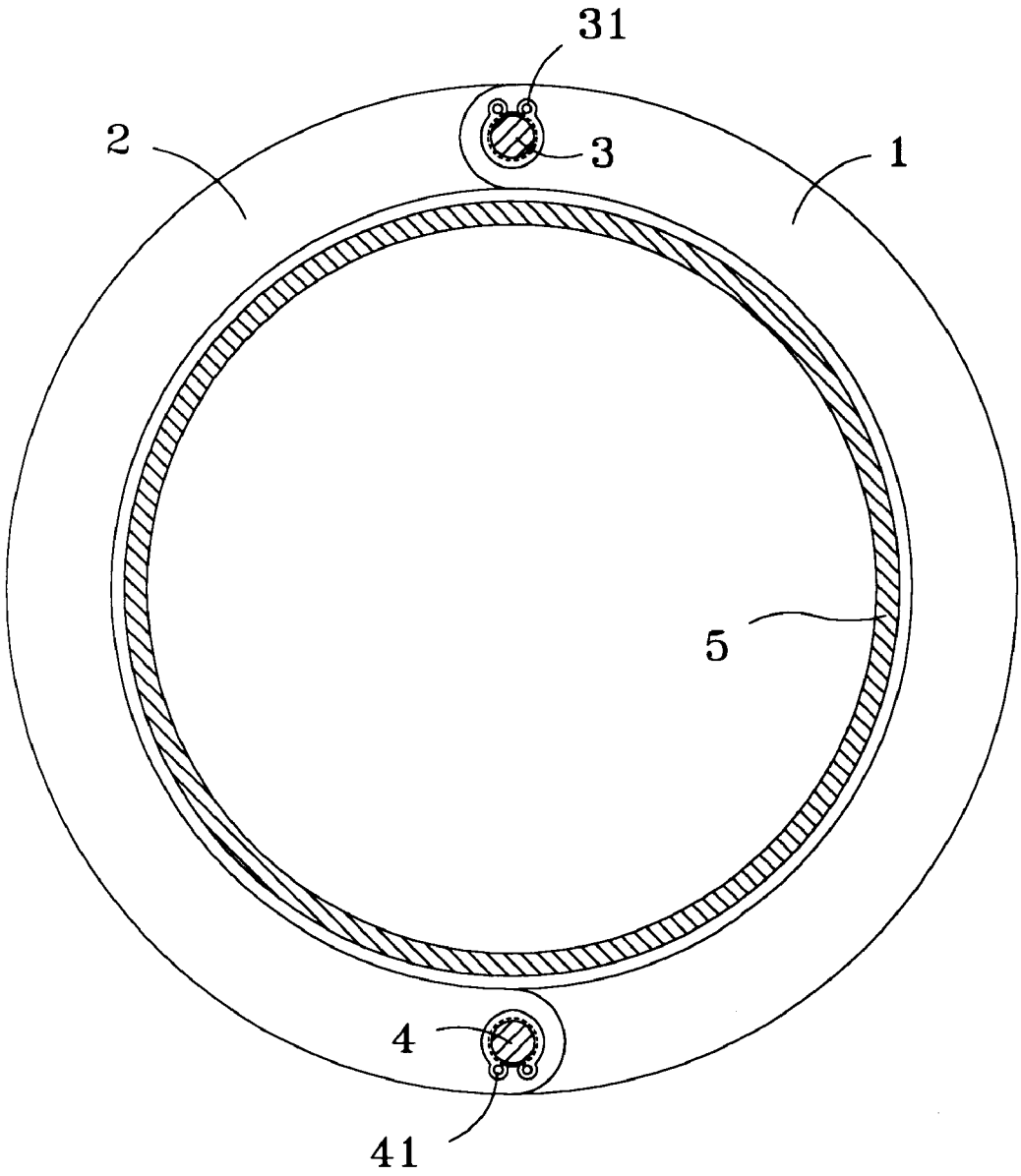
FIG. 2 is a partial sectional schematic side view of the present invention.
Figure 3:
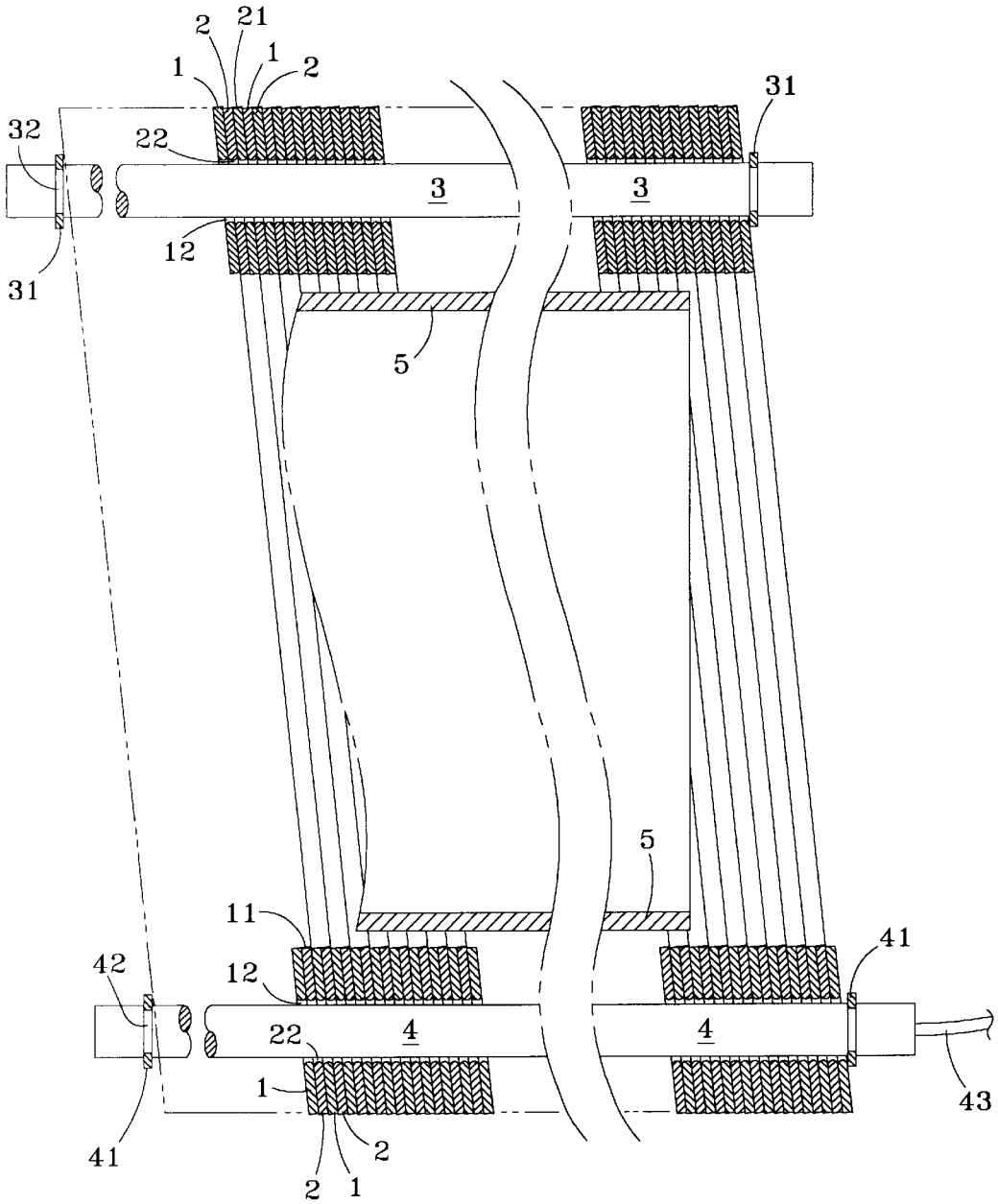
FIG. 3 is another sectional view of the present invention.

Wherein, each half-circled spring element I or 2 is provided on its ends with lapping portions 11 (21) having holes 12 (22) therein. The holes 12, 22 are provided for insertion of the pins 3 and 4 therethrough, to help the half-circled spring elements 1 and 2 to be combined to form a circle. Wherein, the two lapping portions 11 of each half-circled spring element 1 are lapped respectively one over a lapping portion 21 of the half-circled spring element 2 at the left side thereof and the other over a lapping portion 21 of the half-circled spring element 2 at the right side thereof. After lapping, the pins 3 and 4 are inserted through the holes 12, 22 on the lapping portions 11, 21, such that the half-circled spring elements 1 and 2 are strung to be in the form of a spiral spring. The pins 3 and 4 are provided on both the open ends thereof with annular grooves 32, 42 respectively for engagement by the chucking rings 31, 41 to prevent the half-circled spring elements 1 and 2 from dropping. The spring steel wire 43 on the said (at least a) tailing end of the pin 4 is exposed. Thereby, a spiral spring like flexible mould 10 receiving a straight pipe 5 to be bent therein is constructed (referring to FIG. 2 and 3).

The thickness and diameter of the elements (the half-circled spring elements) 1 and 2 used to construct the flexible mould 10 depends on the stiffness of the metallic pipe to be slipped thereover and bending formed. Generally, the thinner the thickness of the spring elements 1 and 2 is, the more favorable it is to scattering of the bending moment acted on the pipe wall in bending forming. That is, the capability in preventing the pipe wall from abnormal deformation is better. The inner diameter of the spring elements 1 and 2 depends on the diameter of the pipe to be inserted. It is alright that the flexible mould 10 constructed can be loosely slipped over the pipe wall. The pins 3 and 4 are made of spring steel just as the spring elements 1 and 2, therefore they have excellent spring nature. They can keep excellent flexibility during a three-dimensional pipe-bending process. The spring steel wire 43 on the said (at least a) tailing end of the pin 4 can be firmly welded or screwed. The spring steel wire 43 has excellent flexibility.

Figure 4:
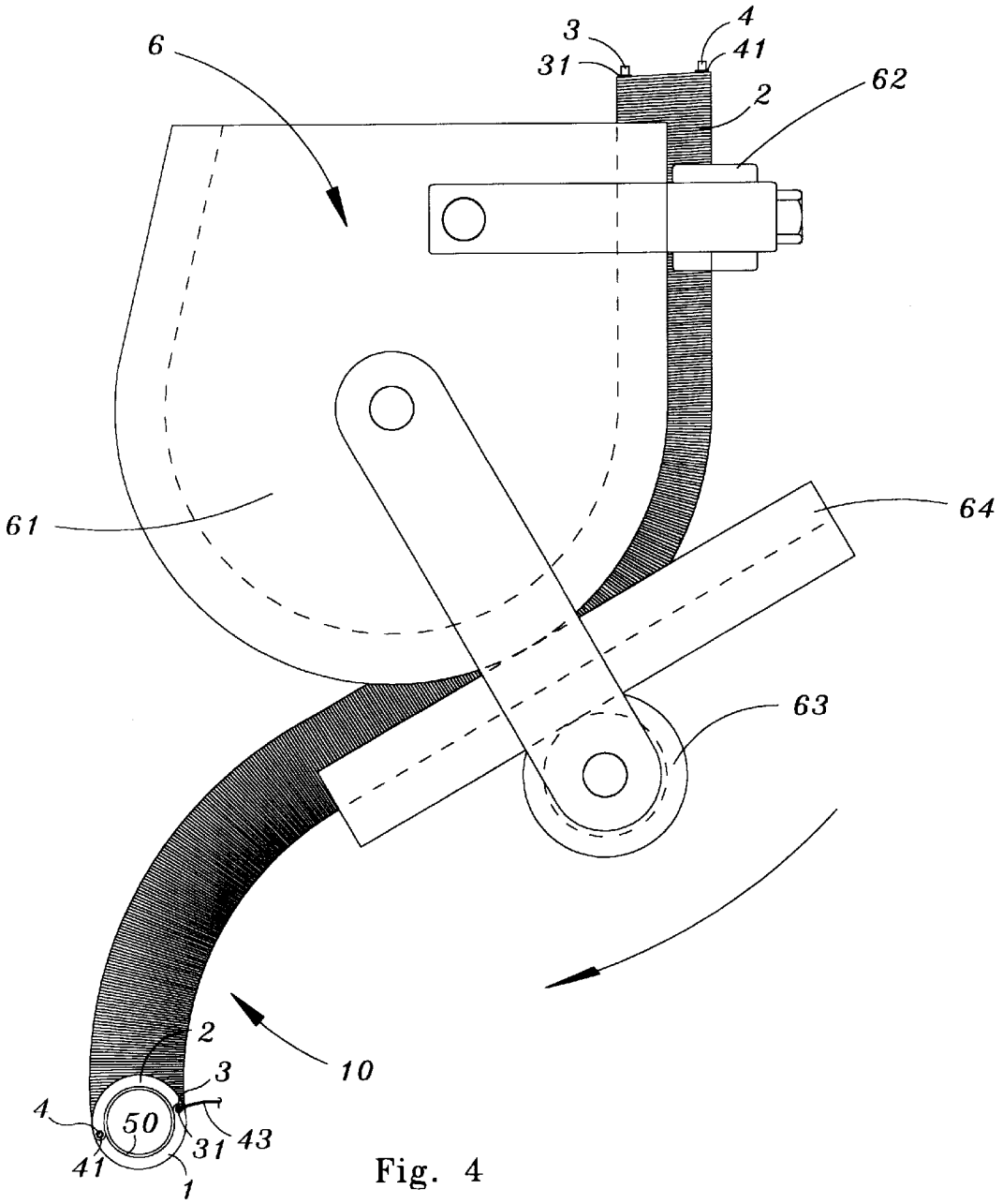
FIG. 4 is a schematic view showing bending forming operation with the present invention on a pipe bending machine.

When it is to bending form the straight pipe 5, after the flexible mould 10 of the present invention is mounted thereover, they are placed as a whole on the bending seat 61 of a pipe bending machine 6. The flexible mould 10 and the straight pipe 5 can thus be under mechanical processing of swaying bending by means of a clamping member 62 and a bending bar 64 on a swaying arm having a wheel 63. And thus can be bending formed a three-dimensional bended pipe 50 (referring to FIG. 4).

Figure 5:
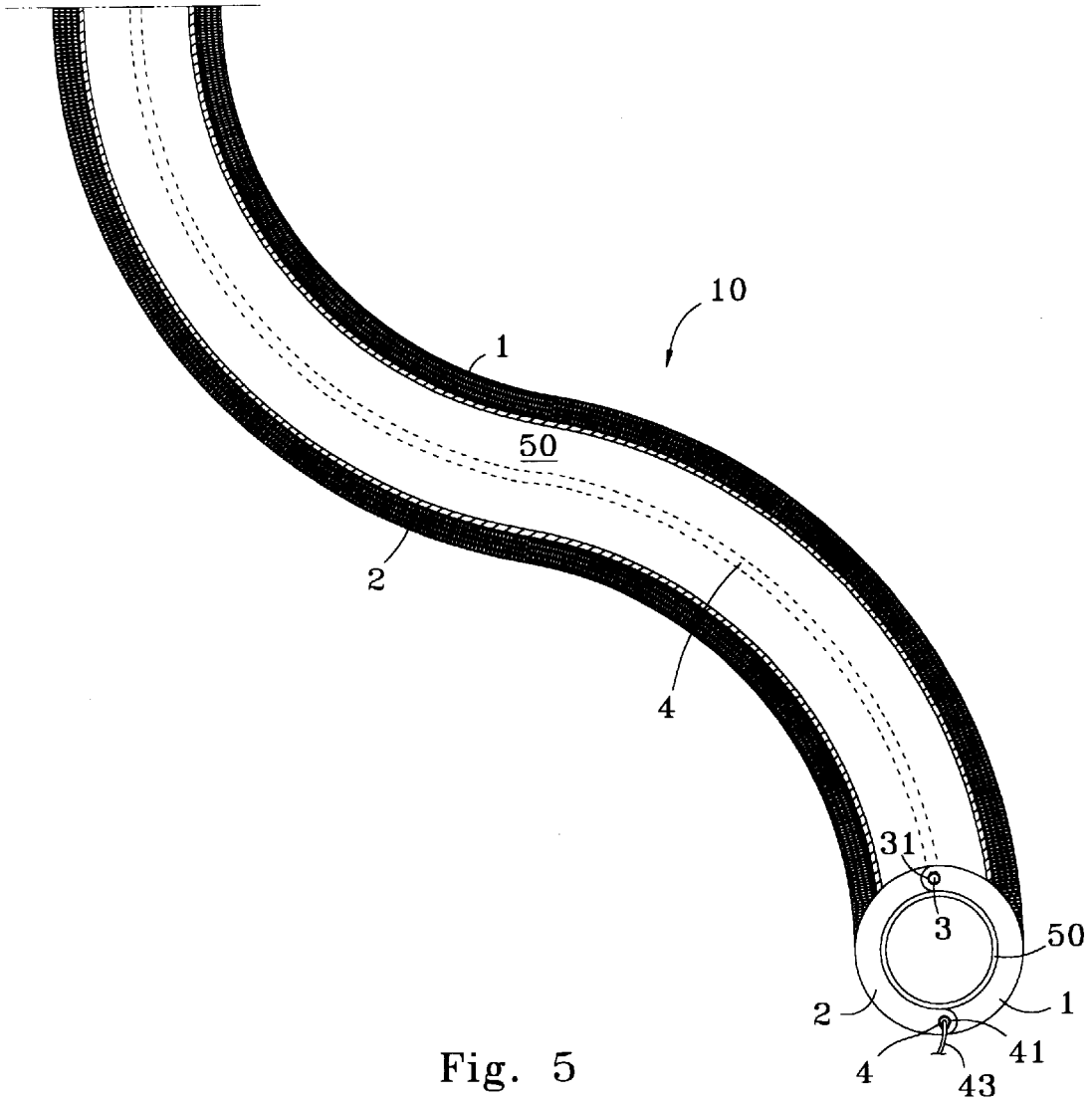
FIG. 5 is a partial sectional view showing distribution of the spring elements on the flexible mould over the pipe after bending forming with the present invention.

As shown in FIG. 5, the flexible mould 10 on the bended pipe 50 after processing by the three-dimensional pipe bending process includes the plural spring elements 1 and 2 and pins 3 and 4. If the plastic mould 10 has not been designed to be convenient for assembling and detaching, the bended pipe 50 formed is difficult in removing of it. Practically, the present invention has been considered about this at the first. And by means of the spring elements 1 and 2 and the pins 3 and 4 removably connected to one another, the spring force stored during bending can be released by taking the chucking rings 41 off the pins 4 and letting free of the holes 12, 22 of the spring elements 1 and 2 for inserting the pins 4. The tailing ends of the pins 4 are connected to steel wires 43, thereby, the spring elements 1 and 2 are not to be loosened and separated after the spring force stored is released. While the flexible mould 10 on the bended pipe 50 can be easily removed at this time to complete the operation of pipe bending.

Having thus described my invention, what I claim as new and desire to be secured by Letters Patent of the United States are:

1. A flexible mold for bending pipes, comprising:

a plurality of spring elements, pins and snap rings to secure said spring elements to said pins, said flexible mold being adapted to receive a straight pipe to be bent by a three-dimensional pipe bending process; wherein said spring elements are all arciform, both ends of each of said spring elements are provided with a hole, said holes receive said pins therethrough, lapping portions on each of said spring elements is lapped over lapping portions of adjacent spring elements, said pins being inserted through said holes on said lapping portions with said spring elements in a lapped orientation, such that said spring elements are in the form of a spiral spring flexible mold, said pins are provided on both ends thereof with an annular groove to receive said snag rings to secure said spring elements on said pins.

2. The flexible mold for bending pipes as defined in claim 1, wherein:

a flexible wire is affixed to one of said ends of each of said pins, said flexible wire being used for releasing said flexible mold.

* * * * *